United States Patent [19]

Göransson et al.

[11] Patent Number: 4,619,173

[45] Date of Patent: Oct. 28, 1986

[54] METHOD AND APPARATUS FOR LIFTING PIECES OF MATERIAL

[75] Inventors: Rolf E. Göransson, Åkarp; Øystein Kalvenes, Lund, both of Sweden

[73] Assignee: Internationella Siporex AB, Malmo, Sweden

[21] Appl. No.: 690,056

[22] Filed: Jan. 9, 1985

[30] Foreign Application Priority Data

Jan. 12, 1984 [SE] Sweden ..... 8400144

[51] Int. Cl.[4] ..... B26D 3/28; B26D 7/06

[52] U.S. Cl. ..... 83/870; 83/24; 83/27; 83/98; 83/152; 83/169; 83/651.1; 414/116; 414/121

[58] Field of Search ..... 83/870–874, 83/98, 152, 651.1, 24, 27, 169; 414/121, 116; 425/297, 305.1; 271/98

[56] References Cited

U.S. PATENT DOCUMENTS

| | | | |
|---|---|---|---|
| 2,217,983 | 10/1940 | Hopkins | 414/116 X |
| 2,848,227 | 8/1958 | Gulick | 271/98 X |
| 4,083,908 | 4/1978 | Kalvenes et al. . | |
| 4,108,933 | 8/1978 | Goransson et al. | 414/121 X |
| 4,174,936 | 11/1979 | Goransson | 83/870 X |
| 4,197,077 | 4/1980 | Kalvenes et al. . | |
| 4,458,891 | 7/1984 | Kawaguchi | 271/98 X |
| 4,470,589 | 9/1984 | Singer | 271/98 X |

FOREIGN PATENT DOCUMENTS 090781 5/1983 European Pat. Off. .

*Primary Examiner*—Frank T. Yost

*Attorney, Agent, or Firm*—Fleit, Jacobson, Cohn & Price

[57] ABSTRACT

To facilitate the lifting of slab-like pieces of material separated from a block of material by substantially horizontal cuts, with the aid of a movable suction device acting upon the upper surface of an upper slab-like piece of material, a pressurized gaseous medium is caused to act in the region of the cut between the upper piece of material and the underlying slab-like piece of material or residual part of the block of material, either prior to and/or while lifting said upper piece. The pressurized medium is supplied into a least one cavity which has an open side and is formed in a movable cover means arranged along a substantially vertical side of the block subsequent to moving the cover means to a position in which it is sealingly connected to and each open cavity side thereof is covered by a portion of said block side, which portion extends along and reaches above and below said region of the cut.

13 Claims, 3 Drawing Figures

METHOD AND APPARATUS FOR LIFTING PIECES OF MATERIAL

The present invention relates to a method for lifting slab-like pieces of material separated from a block of material by substantially horizontal cuts, and in particular from a block of lightweight or aerated concrete which is only partially cured and which is relatively soft and plastic but nevertheless shape-retaining, with the aid of a movable suction device, preferably in the form of a suction beam, acting on the upper surface of an upper piece of material. The invention also relates to apparatus for carrying out the method.

In known methods and apparatus intended herefore, such as the procedural method steps and the apparatus set forth and described in U.S. Pat. Nos. 4,083,908 and 4,197,077 or in EP-Published Specification No. 0 090 781, serious disturbances in operation may occur as a result of sticking between pieces of material or between a piece of material and a residual part of the block of material.

An object of the invention is to provide a method and an apparatus by means of which operational disturbances caused in this way can be avoided, at least to a substantial extent.

To this end the invention provides a method of the aforesaid kind using, in addition to a suction device adapted to act on an upper surface of an upper piece of material, at least one movable cover means arranged along at least one substantially vertical side of said block and having at least one cavity therein with an open side facing said block side, and means for supplying a pressurized, substantially gaseous medium to said cavity, said method comprising moving said cover means to a position in which it is sealingly connected to and the open cavity said thereof is covered by a portion of said block side, said portion extending along and reaching above and below a region of a cut separating said upper piece of material from an underlying slab-like piece of material or residual part of said block of material, and subsequently supplying pressurized, substantially gaseous medium to said cavity prior to and/or while lifting said upper piece of material by said suction device. It is possible in this way to obtain a good release action betwen the upper piece of material and underlying piece of material or underlying residual part of the block of material, even when said material is highly adhesive and when said pieces of material are thin and fragile.

The working medium is advantageously a gaseous medium which has intrinsic anti-stick properties or which contains anti-stick additives.

As before mentioned, the invention also relates to an apparatus for lifting slab-like pieces of material separated from a block of said material by substantially horizontal cuts, particularly from a block of lightweight or aerated concrete which is only partially cured and which is relatively soft and plastic but nevertheless shape-retaining, said apparatus comprising a suction device which is adapted to act on an upper surface of an upper piece of material and is movable to lift said upper piece and carry it away, at least one movable cover means arranged to cooperate with at least one substantially vertical side of said block and having at least one cavity herein with an open side facing said block side, means for moving said cover means to and from a position in which it is sealingly connected to and the open cavity side thereof is covered by a portion of said block side, said portion extending along and reaching above and below a region of a cut separating said upper piece of material from an underlying slab-like piece of material from an underlying slab-like piece of material or residual part of said block of material, and means for supplying pressurized, substantially gaseous medium to said cavity prior to and/or while lifting said upper piece of material by said suction device.

Further characteristic features of and advantages afforded by the method and the apparatus according to the the invention are set forth in the following claims and are made apparent in the following description of an embodiment of apparatus according to the invention chosen by way of example only.

Figure 1:
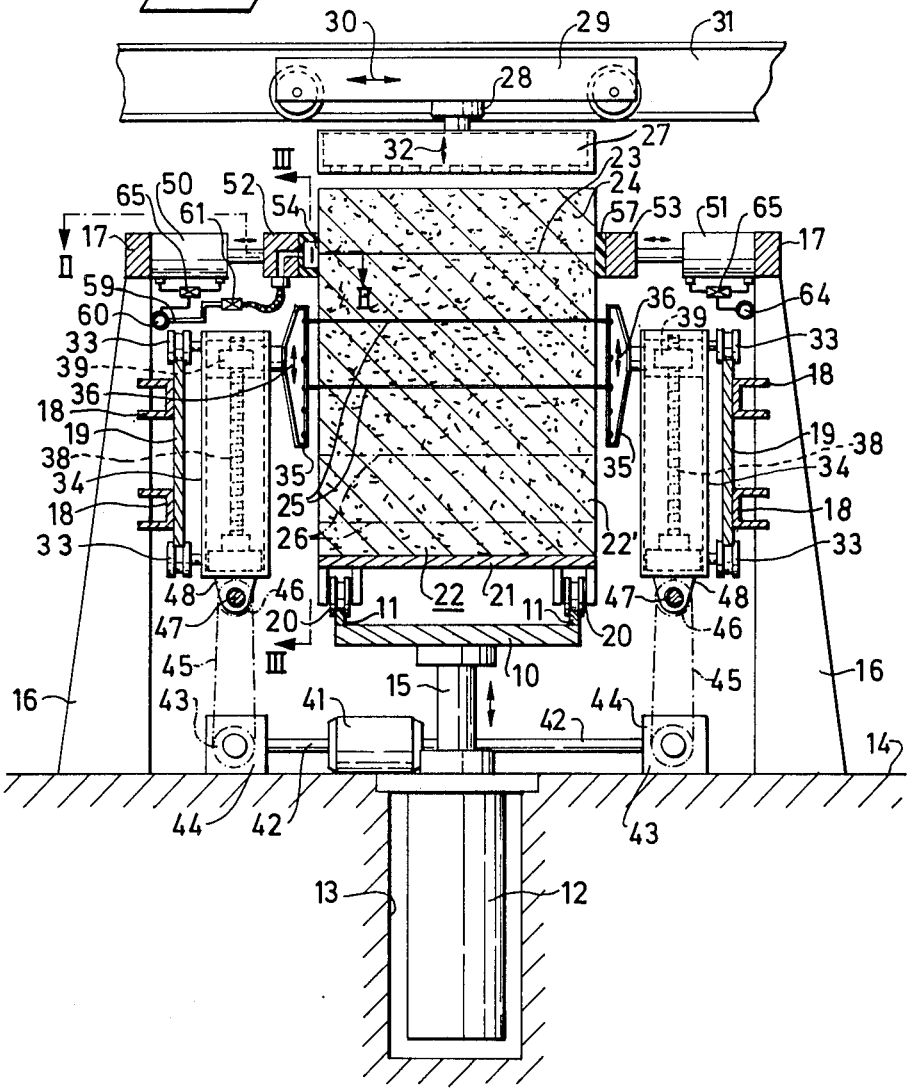
FIG. 1 is a schematic vertical sectional view of an apparatus according to the invention.
Figure 2:
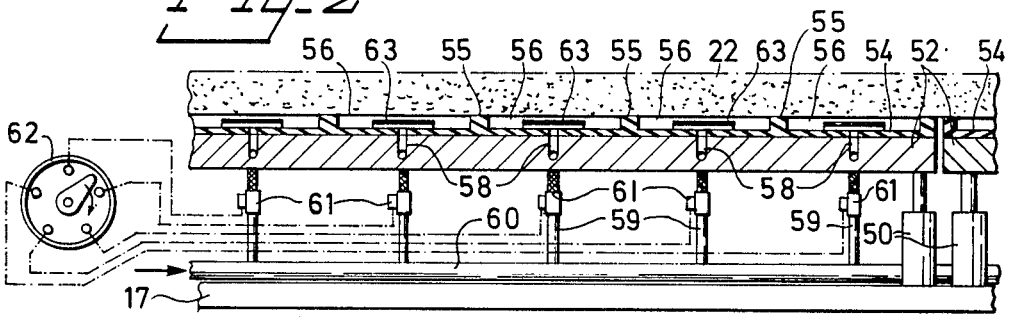
FIG. 2 is a partial sectional view taken on the line II—II in FIG. 1.
Figure 3:
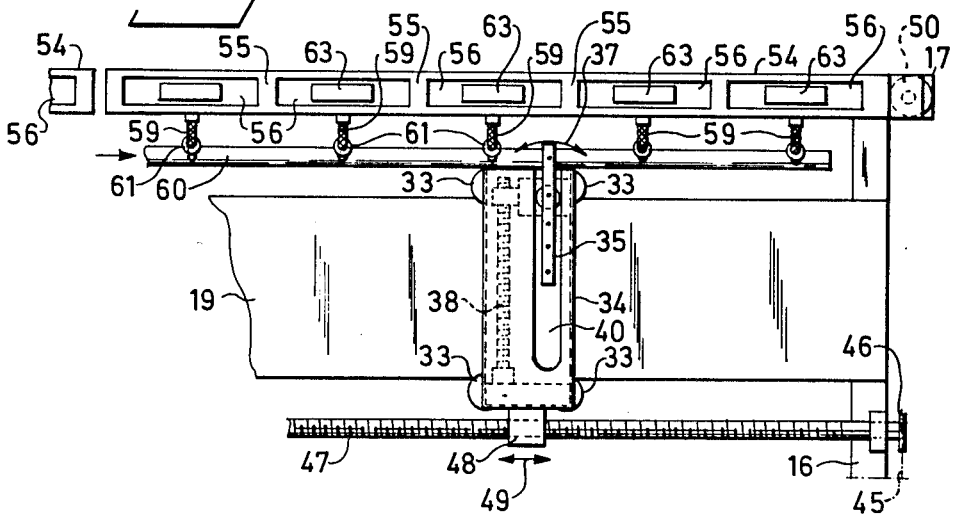
FIG. 3 is a partial sectional view taken on the line III—III in FIG. 1.

The apparatus illustrated in FIGS. 1-3 includes an elongated lifting table 10, which is provided with rails 11 along the long sides thereof and which can be raised and lowered by means of a lifting device, which in the illustrated embodiment has the form of a piston-cylinder device 12. The device 12 is arranged in a pit 13 formed in the supportng floor means 14 and has a vertically movable piston rod 15. The floor means 14 supports along each long side of the table 10 two or more posts 16, which in turn support beams 17 estending in the longitudinal direction of the table and, via holders 18, long plates 19 which also extend in the longitudinal direction of the table 10.

On the partially raised table 10 there is located a carriage 21 supported on wheels 20 and carrying a substantially parallelepipedic block 22 of lightweight or aerated concrete which is partially cured to an extent such that while being plastic it is still shape-retaining. A plate- or slab-like concrete piece 24 has been separated from the upper portion of the block 22, by means of a horizontal cut 23. The reference 25 illustrates cutting wires which are arranged to make cuts similar to the cut 23 and which are located on the levels of further horizontal cuts through the block 22, which cuts although planned have not yet been made. Further similar cuts are planned at locations referenced 26.

Arranged above the block 22 and extending along the whole of its length is a suction beam 27 having the form of a box which has a perforated underside and the interior of which can be connected to a source of sub-pressure, not shown. Arranged for movement forwards and backwards along a track 31, as indicated by the double-headed arrow 30, is a carriage 29 which carries the suction beam 27 via at least one piston-cylinder device 28, by which the suction beam can be raised and lowered in the manner shown by the double-arrow 32.

The upper and lower edges of the plates 19 form horizontal guide paths for the wheels 33 of carriages 34. The cutting wires 25 extend between two raisable and lowerable holders 35, each of which is mounted for rotation in a respective one of the carriages 34, as indicated by respective arrows 36 and 37. More specifically each carriage 34 is shown to accommodate a rotatably journalled vertical threaded spindle 38 which is in screw-engagement with a block 39, such as to enable the block to be raised or lowered by turning the spindle 38 with the aid of a motor, not shown. The spindles 38 are arranged to be driven synchronously, so that the cutting wires 25 are kept horizontal. Each cutting-wire holder 35 is carried for rotation in an associated block 39, the rotational shaft extending horizontally through a vertical slot 40 formed in the carriage (FIG. 3). Synchronously operating motors may also be provided for rotating the holders 35.

The carriages are moved along the plates 19 with the aid of a motor 41, which, via shafts 42, drives gears 44, each of which is provided with a sprocket-wheel 43. The gears 44 drive, via chains 45 synchronously a respective sprocket-wheel 46. Each of the sprocket-wheels 46 is firmly mounted on a respective one of two rotatable journalled horizontal threaded spindles 47, each of which extends beneath and along a respective one of the plates 19 and engages nut means 48 provided on a respective one of the carriages 34, so as, upon rotation in one direction or the other, to drive the carriages 34 along the plates 19 and the block 22 of material, in the manner indicated by the double arrow 49 in FIG. 3.

The beams 17 carry, via piston-cylinder devices 50,51, a plurality of horizontal rails 52,53 arranged in rows along the whole length of the block 22. The rails 52 support hollow cover means or jacket means 54 which are made of a resilient material and are open in a direction facing the block 22, and which are divided longitudinally into cavity defining individual chambers 56, by means of transverse partitions 55. Each rail 53 carries on the side thereof facing the block 22 a resilient lining 57. The rails 52,53 can be moved towards and away from the block 22 by means of the piston-cylinder devices 50,51, between positions in which the cover means 54 and the lining 57 are each in or out of engagement with a respective vertical long side of the block 22. The chambers 56 in the cover means 54 communicate, via inlets 58, with means including branch lines 59, a main line 60, valves 61, and valve control means 62, for conducting a pressurised gaseous medium from a source thereof, not shown, to the chambers 56. Located between the open side of each cover means 54 or each chamber 56 and the inlet 58 thereof is a baffle means 63 which prevents gaseous medium from flowing directly from the inlet 58 towards said open side of the cover means or chamber. As will be seen from FIG. 1, the piston-cylinder device 50 can be driven from the main line 60, while pressurised medium is supplied to the piston-cylinder devices 51 through a further line 64. The reference 65 identifies valves for controlling the supply of pressure medium to the devices 50,51, said valves preferably being programme controlled.

When using the apparatus illustrated in FIGS. 1–3, the pistons of the piston-cylinder devices 12,28,50,51 are in their withdrawn position in the starting position of the apparatus. Thus, the table 10 occupies its lower position and the rails 11 on said table are on a level with, and in register with rails, not shown, along which an empty carriage 21 is removed from the table 10 and a further carriage 21 having a block 22 resting thereupon is moved onto the table 10. The block 22 is then divided into slab-like pieces 24 by means of the cutting wires 25, which are brought to the desired level in relation to the block 22 with the aid of the spindles 38 and/or by changing the level of the table 10 with the aid of the device 12, before causing the wires to cut through the block 22, from end to end, by driving the carriages 34. The thickness of the slabe 24 is set by adjusting the cutting wire holders 35 to the desired position of rotation.

When wishing to lift a slab-like piece 24 from an underlying slab-like piece or from the residual part 22' of a block of material, the suction beam 27 is lowered down onto the upper piece 24 and a suction force or sub-pressure is generated in the beam 27, which is then again lifted, whereupon the lifted piece 24 is conveyed along the path 31 by means of the carriage 29 to a depositing station, not shown. Before being lifted, the table 10 is adjusted so that the cutting plane 23 between the upper piece 24 of material and the block part 22' is placed on a level between the upper and lower sides of the rails 52,53, and the rails 52,53 are moved towards one another and parallel with each other, until the cover means 54 and the linings 57 lie sealingly against opposite sides of the piece 24 and the block part 22' in the region of the cut 23, in the manner illustrated in FIGS. 1 and 2. The inlets 58 of the cover means 54 or chambers 56 are thereupon caused to communicate in sequence with a source of gaseous pressure medium connected to the line 60, by sending an opening signal to each of the valves 61 in sequence, from the valve control means 62 (FIG. 2). Pressurised gaseous medium will then enter the cover means 54 or chambers 56 and will penetrate into and act in the region of the cut 23, in a manner to remove any tendency of the piece 24 and the block 22' to stick to one another, therewith enabling the piece 24 to be readily lifted by means of the suction beam 27. The lining 57 prevents pressure medium from escaping on the side of the piece 24 and the part 22' opposite the covers 54. The piston rods of the piston-cylinder devices 50,51 can be withdrawn, before lifting the piece 24 with the aid of the suction beam 27. Subsequent to separating new pieces 24 from the residual block-part 22', the table 10 is raised through a distance corrsponding to the thickness of one piece 24 and gaseous pressure medium is passed to the now uppermost cutting plane 23.

The invention is particularly suited for application in conjunction with the division of blocks of partially cured lightweight or aerated concrete into slab-like pieces and stacking of the pieces in reversed order on a supporting surface, on which they are then charged to an autoclave and there finally cured. In this respect, there can be introduced into the region of the cut 23 a gaseous medium which either has intrinsic anti-stick properties, for example carbon dioxide, or to which additives having anti-stick properties have been added. Examples of such additives are powder suspensions of inert material, for example calcium carbonate, sand or aerated concrete flour, milk of lime, e.g. 15%-calcium hydroxide suspension, or aluminum suspension, e.g. a mixture of 5–10 g Al-powder and 100 g aluminum sulphate, $Al_2(SO_4)_3 \cdot 18\ H_2O$, in 1000 g water.

The invention is not restricted to the embodiment described above and illustrated in the drawing, but modifications can be made within the scope of the invention as defined in the following claims. For example, the block 22 can be divided with the aid of cutting wires 25 in a separate station, before moving the divided block onto the table 10. Similarly the pieces 24 can be divided transversely and/or longitudinally before being lifted with the aid of the suction beam 27 or like means. In this respect, the pieces can be divided transversely with the aid of transversely extending raisable and lowerable cutting wires (not shown) capable of passing between adjacent rails 52 and rails 53.

We claim:

1. A method of lifting slab-like pieces of material separated by substantially horizontal cuts, from a block of light-weight or aerated concrete material which is only partially cured and which is relatively soft and plastic but nevertheless shape-retaining, the method using a suction device adapted to act on an upper surface of an upper piece of material, at least one movable cover means arranged along at least one substantially vertical side of said block and having at least one cavity therein with an open side facing said block side, and means for supplying a pressurized, substantially gaseous medium to said cavity, said method comprising moving said cover means to a position in which it is sealingly connected to and the open cavity side thereof is covered by a portion of said block side, said portion extending along and reaching above and below a region of a cut separating said upper piece of material from an underlying slab-like piece of material or residual part of said block of material, and subsequently supplying pressurized, substantially gaseous medium to said cavity prior to lifting said upper piece of material by said suction device.

2. A method according to claim 1, further comprising using a

3. A method according to claim 1, further comprising using a gaseous medium which has anti-stick additives incorporated therewith.

4. A method according to claim 1, further comprising preventing the gaseous medium supplied to said cavity from flowing directly towards the open side of said cavity.

5. A method according to claim 1, further comprising supplying the gaseous medium to a plurality of cavities in said cover means in a given sequence.

6. A method according to claim 1, further comprising the step of positioning a liner in sealing relationship to said cut separating said upper piece of material and said underlying piece of material or residual part of said block, on a side of said block opposite from the side to which said cover means is sealingly connected.

7. An apparatus for lifting slab-like pieces of material separated by substantially horizontal cuts, from a block of light-weight or aerated concrete material which is only partially cured and which is relatively soft and plastic but nevertheless shape-retaining, said apparatus comprising a suction device which is adapted to act on an upper surface of an upper piece of material and is movable to lift said upper piece and carry it away, at least one movable cover means arranged to cooperate with at least one substantially vertical side of said block and having at least one cavity therein with an open side facing said block side, means for moving said cover means to and from a position in which it is sealingly connected to and the open cavity side thereof is covered by a portion of said block side, said portion extending along and reaching above and below a region of a cut separating said upper piece of material from an underlying slab-like piece of material or residual part of said block of material, means for supplying pressurized, substantially gaseous medium to said cavity prior to lifting said upper piece of material by said suction device, and means in each cavity for preventing gaseous medium from flowing directly towards the open side of said cavity.

8. An apparatus according to claim 7, wherein the cover means is divided into a plurality of chambers by means of substantially vertical transverse partitions intersecting the region of the cut in said position, each of said chambers defining a respective cavity having an open side and an inlet for said gaseous medium.

9. An apparatus according to claim 7, wherein said cover means include a plurality of cavities and said supply means include means for conducting pressurized gaseous medium to said cavities in a given sequence.

10. An apparatus according to claim 7, including raisable and lowerable cutting wire holders which are horizontally movable relative to the block of material and which have at least two cutting wires located at mutually different levels and which, for the purpose of setting the vertical distance between the cutting wires, can be rotated and adjusted to desired rotational positions about a horizontal rotational axis extending substantially at right angles to the horizontal direction of movement of said cutting wire holders.

11. An apparatus according claim 7, further comprising movable liner means for sealing said cut separating said upper piece of material and said underlying piece of material or residual part of said block, on a side of said block opposite from the side to which said cover means is sealingly connected.

12. An apparatus for lifting slab-like pieces of material separated by substantially horizontal cuts, from a block of light-weight or aerated concrete material which is only partially cured and which is relatively soft and plastic but nevertheless shape-retaining, said apparatus comprising a suction device which is adapted to act on an upper surface of an upper piece of material and is movable to lift said upper piece and carry it away, at least one movable cover means arranged to cooperate with at least one substantially vertical side of said block and having a plurality of cavities therein with an open side facing said block side, means for moving said cover means to and from a position in which it is sealingly connected to and the open cavity side thereof is covered by a portion of said block side, said portion extending along and reaching above and below a region of a cut separating said upper piece of material from an underlying slab-like piece of material or residual part of said block of material, and means for supplying pressurized, substantially gaseous medium to said cavities in a given sequence prior to lifting said upper piece of material by said suction device.

13. An apparatus for lifting slab-like pieces of material separated by substantially horizontal cuts, from a block of light-weight or aerated concrete material which is only partially cured and which is relatively soft and plastic but nevertheless shape-retaining, said apparatus comprising a suction device which is adapted to act on an upper surface of an upper piece of material and is movable to lift said upper piece and carry it away, at least one movable cover means arranged to cooperate with at least one substantially vertical side of said block and having at least one cavity therein with an open side facing said block side, means for moving said cover means to and from a position in which it is sealingly connected to and the open cavity side thereof is covered by a portion of said block side, said portion extending along and reaching above and below a region of a cut separating said upper piece of material from an underlying slab-like piece of material or residual part of said block of material, means for supplying pressurized, substantially gaseous medium to said cavity prior to lifting said upper piece of material by said suction device, and raisable and lowerable cutting wire holders which are horizontally movable relative to the block of material and which have at least two cutting wires located at mutually different levels and which, for the purpose of setting the vertical distance between the cutting wires, can be rotated and adjusted to desired rotational positions about a horizontal rotational axis extending substantially at right angles to the horizontal direction of movement of said cutting wire holders.

* * * * *